US007124893B2

(12) United States Patent
Winckels

(10) Patent No.: US 7,124,893 B2
(45) Date of Patent: Oct. 24, 2006

(54) PACKAGING UNIT FOR AN ARTICLE ALLOWING IT TO BE SEEN

(75) Inventor: Mathilde Winckels, Clichy (FR)

(73) Assignee: L'Oreal, Paris (FR)

( * ) Notice: Subject to any disclaimer, the term of this patent is extended or adjusted under 35 U.S.C. 154(b) by 305 days.

(21) Appl. No.: 10/773,319

(22) Filed: Feb. 9, 2004

(65) Prior Publication Data

US 2004/0168952 A1 Sep. 2, 2004

Related U.S. Application Data

(60) Provisional application No. 60/449,877, filed on Feb. 27, 2003.

(30) Foreign Application Priority Data

Feb. 7, 2003 (FR) ..... 03 01480

(51) Int. Cl.
*B65D 69/00* (2006.01)
*B65D 73/00* (2006.01)
*G09F 19/14* (2006.01)

(52) U.S. Cl. ..... 206/581; 206/457; 40/453

(58) Field of Classification Search ..... 206/446, 206/769, 581, 457, 459.5, 823, 776, 777, 206/459.1; 40/453, 454, 312; 359/1
See application file for complete search history.

(56) References Cited

U.S. PATENT DOCUMENTS 386,780 A * 7/1888 Heinemann ..... 40/453
386,883 A * 7/1888 Heinemann ..... 40/453
401,164 A * 4/1889 Heinemann ..... 40/453
922,015 A * 5/1909 Miller ..... 40/453
1,353,363 A * 9/1920 Simon ..... 40/453
1,967,658 A * 7/1934 Buescher et al. ..... 40/453
2,847,783 A * 8/1958 Anderson ..... 40/453
2,851,804 A * 9/1958 Roach ..... 40/539
3,290,814 A 12/1966 Jelinek
3,683,525 A * 8/1972 Fukui ..... 40/453
4,282,669 A * 8/1981 Rieumont ..... 40/453
4,611,611 A * 9/1986 Beal, Jr. ..... 132/320
5,142,384 A * 8/1992 Wood et al. ..... 206/457
5,966,105 A * 10/1999 Gundlach ..... 40/454
6,023,866 A 2/2000 Polsky

FOREIGN PATENT DOCUMENTS

| | | |
|---|---|---|
| EP | 0 403 134 | 12/1990 |
| FR | 553 380 | 5/1923 |
| FR | 1 012 868 | 7/1952 |
| FR | 1 372 613 | 9/1964 |

* cited by examiner

*Primary Examiner*—Mickey Yu
*Assistant Examiner*—J. Gregory Pickett
(74) *Attorney, Agent, or Firm*—Oblon, Spivak, McClelland, Maier & Neustadt, P.C.

(57) ABSTRACT

A packaging unit delimiting a space in which an article can be located such as an article containing a cosmetic product. The packaging includes at least one portion configured so that, when seen in a first direction, at least a part of the article can be seen and, when seen in a second direction different from the first, a first decorative motif can be seen. The portion includes at least one first transparent element allowing the article to be viewed, and at least one second element having the first motif associated, with the two elements extending in different planes.

32 Claims, 3 Drawing Sheets

10
20
B
12
22b
22c 10
13
11
12
14
20
23
22b
22a
21
22c
22
P 10
12
20
21
22
22b
22c
30
22a 20
22c
22a
A
12
10

PACKAGING UNIT FOR AN ARTICLE ALLOWING IT TO BE SEEN

CROSS REFERENCE TO RELATED APPLICATIONS

This document claims priority to French Application Number 03 01480, filed Feb. 7, 2003 and U.S. Provisional Application No. 60/449,877, filed Feb. 27, 2003, the entire contents of which are hereby incorporated by reference.

BACKGROUND OF THE INVENTION

1. Field of the Invention

The present invention relates to a packaging unit for an article such as an article containing a cosmetic product, and in particular a case or a small box.

2. Discussion of Background

There are known types of packaging which include viewing windows allowing the product located inside the packaging to be viewed. Such a window, however, reduces the surface area of the packaging on which a decorative motif or an inscription can be printed. However, if the packaging does not include a window, in order to exploit the entire surface for decoration, it is not possible to view the article without opening the packaging.

EP 0 403 134 likewise describes a packaging unit which includes a window to enable an article inside the packaging to be seen. The window is formed by a hologram. Depending on the angle at which it is viewed, this arrangement allows for the image carried by the hologram, or the article which is present inside the packaging, to be seen. Holograms, however, require certain lighting conditions in order for the image which they carry to be correctly visualized. In addition, because holograms are generally colored, it will only be possible to see the article located inside the packaging through the colored window, in such a way that the true aesthetic qualities of the article cannot be seen.

U.S. Pat. No. 6,023,866 on the other hand describes an item in the form of a card having a support element on which are located strips bearing portions of an image in such a way as to form several images. The card is not configured in such as way as to be used to package an article.

SUMMARY OF THE INVENTION

It is an object of the invention to provide a packaging unit for an article which will allow the purchaser to see the article while still allowing for a surface to be obtained which can accommodate a relatively large decorative motif.

It is another object of the invention to provide a packaging unit with a new decorative effect.

According to the invention these objects can be achieved by a packaging unit which delimits a space in which an article is located containing a cosmetic product. In accordance with a preferred arrangement, at least one portion is configured to allow at least a part of the article to be seen when viewed in a first direction. When viewed in a second direction different from the first, a first decorative motif can be seen. The arrangement includes at least a first transparent element enabling the article to be viewed and at least a second element covered by the first motif, with the two elements extending in different planes. The arrangement can also be configured such that, in a third direction of observation distinct from the first and the second, a second decorative motif can be seen which is identical to or different than the first.

A packaging unit of this kind allows for the article which it contains to be observed from the outside without opening the packaging, while still providing an external surface of considerable size for decoration.

According to another advantageous aspect, the packaging offers several different views according to the position in which it is being observed. Accordingly, depending on how one moves in relation to the packaging, it is possible to perceive different types of decoration and/or the article. In addition, depending upon the vantage point, one can view, separately or simultaneously, part of the decoration and part of the article itself. With this arrangement, it is possible to adorn points of sale, and in particular shop display windows, at a low cost.

According to an example of the invention, the first transparent element can include a transparent material or even be formed by an opening. This allows the real aesthetic appeal of the article to be visualized. A second packaging element can take the form of a strip, and preferably can include several strips arranged in parallel with one another.

The viewing arrangement can include an insert formed of a sheet folded into a plurality of strips. Alternatively, the viewing portion can include an insert formed by the extrusion of a thermoplastic material or by molding of a single piece of thermoplastic material, in particular by injection molding or thermoforming.

The packaging can take the form of a box or case. In a particularly preferred form, the arrangement is used to pack an article containing a cosmetic product.

According to one of the advantageous aspects of the invention, a packaging unit is provided which delimits a space suitable for containing an article, and which includes at least one portion which, viewed from a first direction, is configured to allow viewing of at least a part of the article and which, viewed from a second direction different from the first, allows a first decorative motif to be seen. This portion includes at least one first element, made of transparent material, allowing for the viewing of the article, and at least one second element covered by the first motif, with the two elements extending in different planes.

The above and other advantageous aspects of the invention will become apparent from the examples disclosed herein. It is to be understood that implementations of the invention need not include every feature of the illustrated examples, but instead could include only some or portions of the illustrated embodiments, or could include variations of the examples described. In addition, implementations need not achieve all of the above described objectives, but might only partially achieve the above objectives as desired.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figures 1, 1A, 1B, 1C:
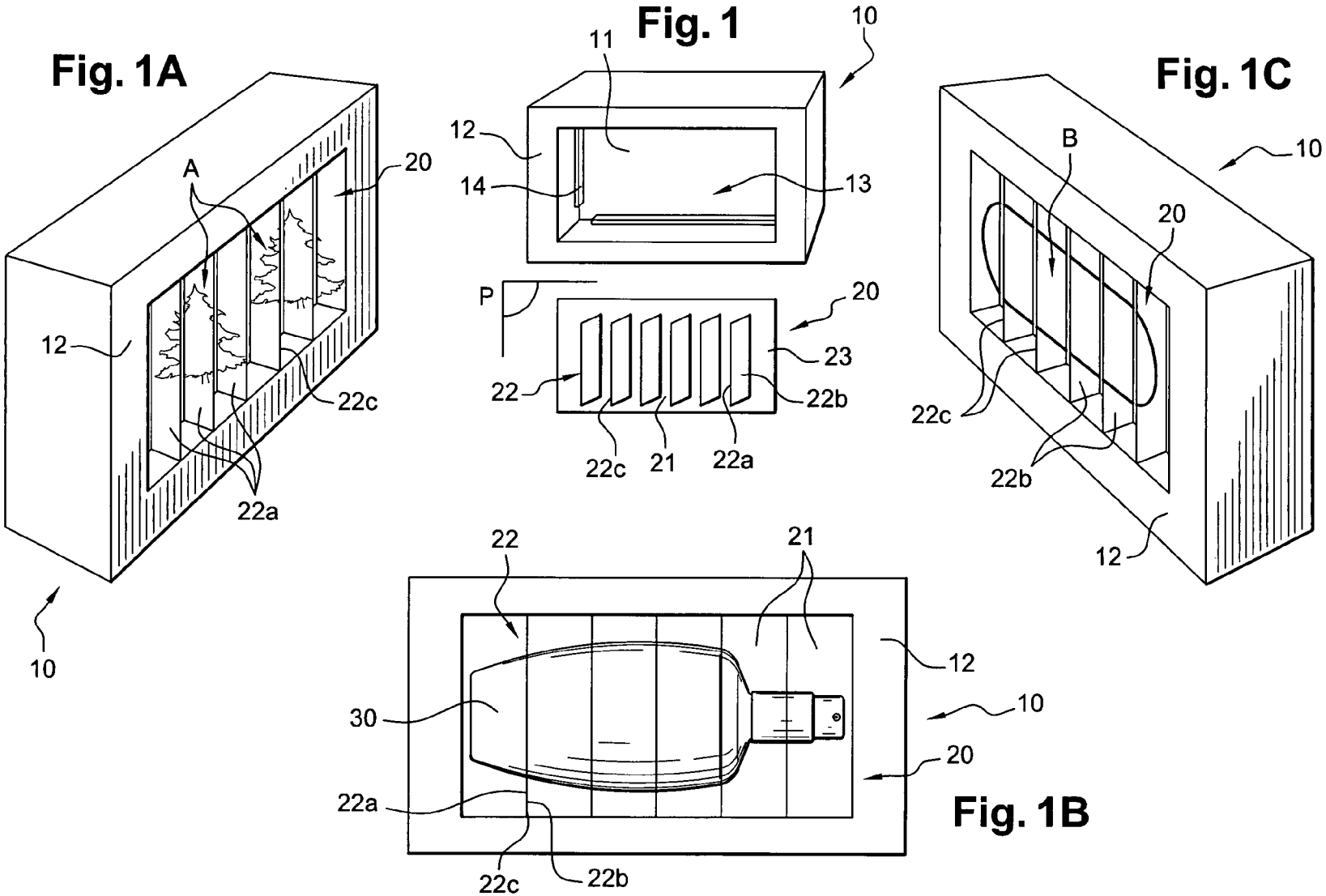
FIG. 1 represents an exploded view of a package according to a first embodiment of the invention.
FIGS. 1A to 1C show perspective views from three different directions of the package according to the first embodiment.

The packaging unit 10 represented in FIGS. 1 and 1A to 1C, is in the form of a case. It delimits a space 11 intended to accommodate a bottle of perfume 30, for example. The case 10 is a parallelepiped in shape and made of thermoplastic material. Alternatively, the case can be made of any other material, such as cardboard, wood, metal, etc. The illustrated example includes six faces, of which one face 12 is traversed by a window 13, rectangular in shape, for example. The window 13 may, as an alternative, be square, circular, oval, or any other shape. In addition, the case or package can have various other shapes. An insert 20 is fixed in the window 13.

The insert 20 includes a transparent sheet 21 extending in a plane P. Several identical small strips 22, each having two opposed faces 22*a* and 22*b*, preferably extend in a plane perpendicular to the plane P of the sheet 21, with the small strips preferably arranged parallel to one another. A portion 23 of the sheet 21 preferably surrounds the small strips 22 in such a way as to form a peripheral frame which is intended to be fixed onto the inside surface of the face 12 of the case, all around the window 13. Preferably, the sheet is recessed such that the small strips do not impinge on the face 12. For example, the arrangement can be adhesively bonded to the inside surface of a recess 14 surrounding the window. The sheet 21 and the small strips 22 can be formed from a single piece, for example, by extrusion of a thermoplastic material.

A protective film, not shown, could also be provided to protect the small strips from the outside. The film may, for example, be fixed to the opposite side of the sheet 21 in relation to the strips, on the outer surface of the face 12.

A first decorative motif A, for example of trees, is drawn on a first face 22*a* of the strips. In the illustrated arrangement, the entire motif is distributed over the faces 22*a*, with each face having a portion of the motif or design. The motif could also be formed by or take the form of an inscription or printing relating to the article. A second decorative motif B, such as a geometric form substantially oval in shape in the illustrated example, is drawn on the second face 22*b* of the strips, opposite the first. As with the design or motif on the first faces, the motif on the second faces can be distributed over all of the faces 22*b* or over a plurality of the faces.

When the case is viewed in a direction perpendicular to the plane P of the sheet 21, the perfume bottle 30 (or other cosmetic container) is seen across the sheet 21 which is transparent, as well as the segment 22*c* of the strips 22 (see FIG. 1B). When the case is viewed in a direction forming an angle of, for example, 45° in relation to the sheet 21, from the left, the first motif A, namely the trees, is seen, which motif is represented on the faces 22*a* of the strips, without seeing the bottle (see FIG. 1A). When viewed in a direction forming an angle of, for example, 45° in relation to the sheet 21, from the right, the second motif B can be seen, namely the oval geometric shape, which is represented on the faces 22*b* of the strips. Between these viewing positions it is possible, from intermediate directions, to see in part the perfume bottle and in part one of the motifs A or B.

Figure 2A:
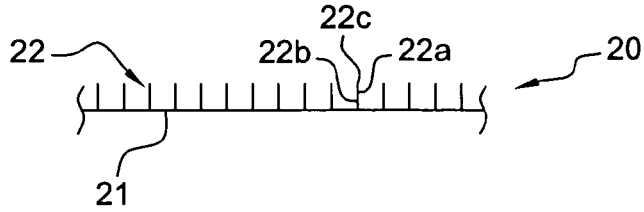
FIGS. 2A to 2C represent the different stages of a method of producing an insert arranged in the package illustrated in FIGS. 1 and 1A to 1C.
Figure 2B:
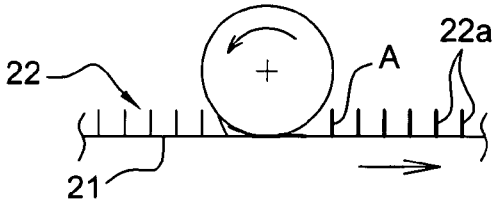
Figure 2C:
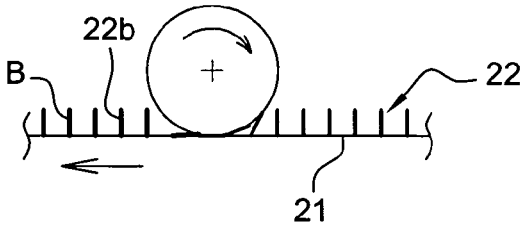

In order to form the insert 20, a thermoplastic material can be extruded such as, for example, polypropylene, polyethylene or polyethylene terephthalate, in such a way as to form the sheet 21 and the strips 22 arranged in a perpendicular manner to the sheet, as can be seen in FIG. 2A. A printing roller is then passed over the insert 20, displacing it in a manner perpendicular to the strips 22, as represented in FIG. 2B. The first decorative motif A is thus printed on the faces 22*a*. A printing roller is then passed in the other direction in such a way as to print the second decorative motif B on the second faces 22*b* opposite the first faces (see FIG. 2C). When the roller is passed, the small strips 22 are flattened out in such a way that they protect against any printing on the sheet 21 of the insert, which remains transparent.

The insert which is thus obtained is inserted in the case which can be formed in a conventional manner. The insert 20 is, for example, adhesively bonded over its entire periphery 23 to the inside surface of the face 12 surrounding the window, in particular on the inside surface of the recess 14. Alternately, the insert could be coupled or fixed by other expedients and/or could be coupled at selected locations rather than the entire periphery.

According to a variant which is not shown, the wall in which the window is formed can be curved. This can be, for example, a packaging unit that is cylindrical in shape. The strips are then no longer arranged in a parallel manner to one another, and are each arranged perpendicular to the curved wall. According to this embodiment, each motif or portions of one or more motifs appear in a progressive manner as the viewer moves along this curve.

Figure 3C:
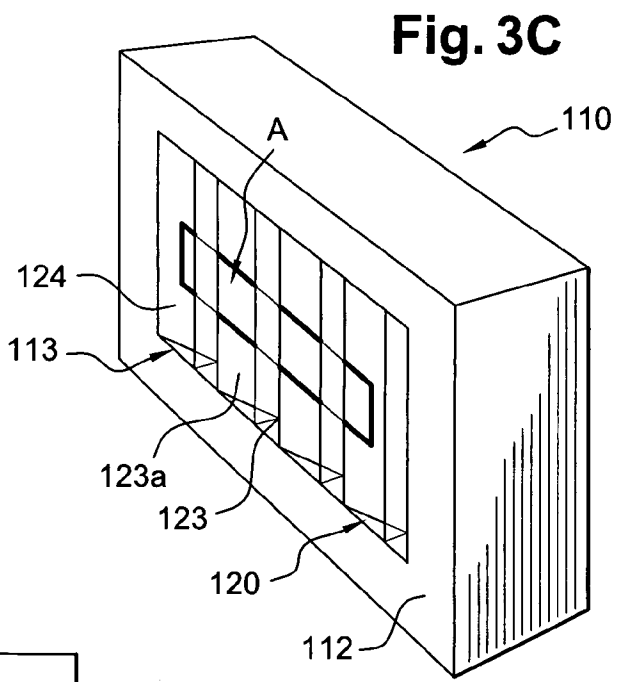
FIGS. 3A to 3C show perspective views from three different directions of a package according to a second embodiment.
Figure 3B:
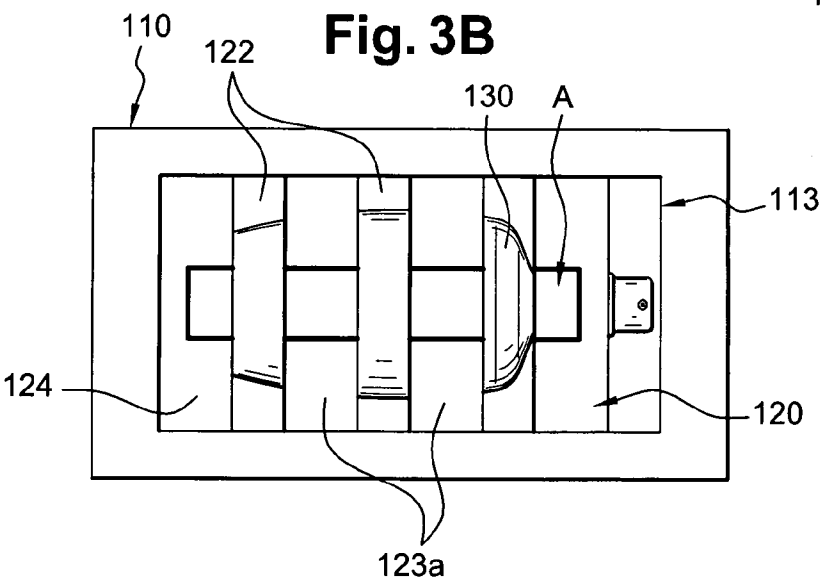
Figure 3A:
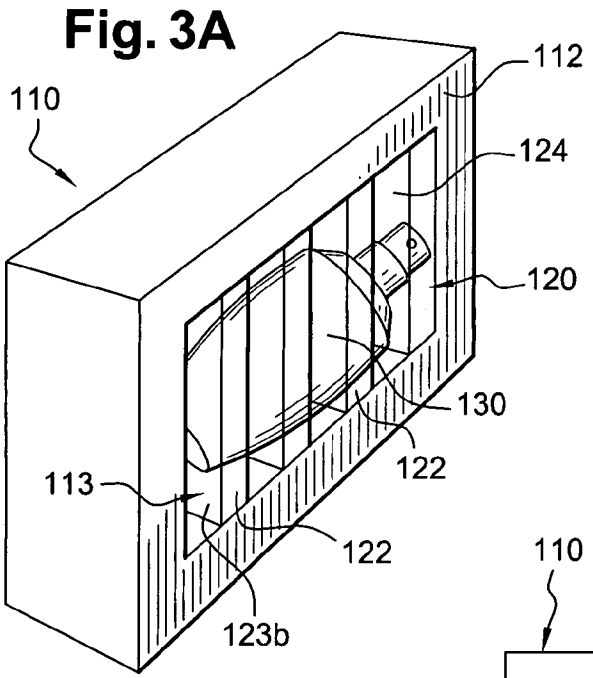

The packaging unit 110 represented in FIGS. 3A to 3C is in the form of a case or box identical to that which has just been described, but having an insert 120 which differs from that which has just been described. A perfume bottle 130 is likewise located in the interior of the packaging unit.

Figure 4A:
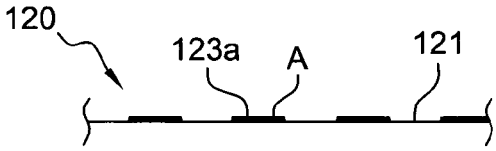
FIGS. 4A to 4C represent the different stages of a method of producing an insert arranged in the package illustrated in FIGS. 3A to 3C.
Figure 4B:
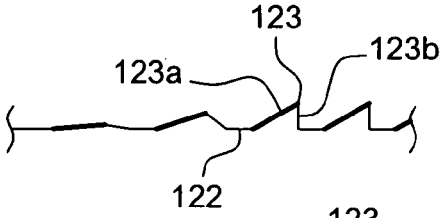
Figure 4C:
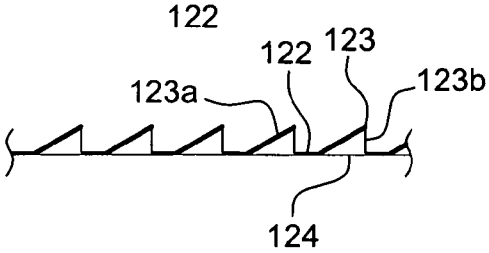

The insert 120 is formed by a sheet 121 folded in such a way as to form first strips 122, arranged on the same plane, separated by ridges 123 formed by second and third strips 123*a* and 123*b*. In order to form the insert, a sheet 121 is taken as the starting point, which sheet is initially transparent, and on which is printed a decorative motif A, such as a rectangle (FIG. 4A). The motif A can be spread or distributed over the second strips 123*a*, while the rest of the sheet 121, namely the strips 122 and 123*b*, remain transparent. The second strips 123*a* are folded in such a way as to form an angle of preferably 45°, by way of example, in relation to the plane of the strips 122 and the third strips 123*b* are folded in such a way as to form an angle of 90° in relation to the plane of the strips 122 (see FIG. 4B). A transparent support film 124 can also be adhesively bonded to the faces of the first strips 122, opposite the ridges 123, in such a way as to support the sheet 121 folded in this manner (see FIG. 4C).

The insert 120 obtained in this way can be fixed in the case 130 by adhesively bonding, for example, the periphery of the film 124 to the inside surface of the face 112, around the window 130, with the ridges 123 oriented towards the interior of the case.

Alternatively, the insert 120 can be fixed in the other direction, namely by arranging the ridges 123 toward the outside of the case and the film 124 toward the inside. The insert can then be adhesively bonded at its periphery to the case, for example, on a recess provided around the window 113, preferably in such a way that the ridges do not impinge on or protrude from the window. Provision can then be made for a protective film which protects the insert from the outside, which can be fixed to the opposite side of the film 124 and adhesively bonded to the outer surface of the face 112.

According to this embodiment, when the case is viewed in a direction or from a vantage point perpendicular to the plane of the strips 122, the first motif A on the strips 123*a* is seen in part, and in part the perfume bottle (or other cosmetic container) is seen across the first transparent strips 122 and the film 124 (FIG. 3B). When viewed in a direction forming an angle of 45° in relation to the plane of the strips 122, from the left, the perfume bottle 130 is seen across the strips 122 and 123*b* and the film 124 (FIG. 3A). Finally, when seen in a direction forming an angle of 45° in relation to the plane of the strips 122, from the right, only the motif is seen, namely the rectangle which is represented on the second strips 123*a*, without the perfume bottle being seen.

Figure 5:
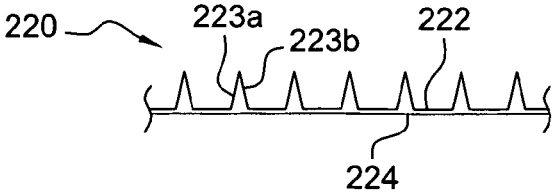
FIG. 5 represents a variant of the second embodiment.

According to a variant of this second embodiment represented in FIG. 5, the three strips can have a substantially identical width. The first strips 222 are transparent, while a first motif A is printed on the second strips 223*a* and a second motif B is printed on the third strips 223*b*. The second and third strips with this arrangement can be adhesively bonded to one another, and can be arranged in a substantially perpendicular manner to the first strips 222 which extend in the same plane. A transparent support film 224 can further be adhesively bonded to the faces of the first strips 222 in such a way as to support the whole of the sheet folded in this manner. Accordingly, the same visual effect is achieved as with the insert described in the first embodiment. As with the earlier embodiments having plural motifs, the motif viewable at one angle can be the same or different from the motif viewable at another angle.

According to another embodiment, not shown, the insert can be formed by a peripheral frame which extends in one plane and delimits a rectangular opening, and by the associated strips. The strips can be arranged parallel to each other, and each extend, for example, in a plane perpendicular to the plane of the frame or in other words the plane along which the opening defined by the frame extends. The two ends of the strips are, for example, inserted into slots provided in the frame in such a way as to be maintained in the frame at an angle with respect to the plane of the frame. According to this embodiment, the strips can be printed on one face only, or on both their faces, before being inserted into the frame. They can, for example, be printed before being cut into strips, or after being cut. In this case, the same visual effect is again obtained as with the insert described in the first embodiment, with the perfume bottle being visible when the case is viewed in a direction perpendicular to the plane of the frame, looking across the opening.

It is of course possible to provide a box or case comprising several windows, each provided with an insert such as that which has just been described.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A packaging unit having a space for holding an article containing a cosmetic product, the packaging unit further comprising:

an article containing a cosmetic product, wherein said article is disposed in said space;

at least one portion configured such that, when seen in a first direction, at least a part of the article can be seen and, when seen in a second direction different from the first, a first decorative motif can be seen;

wherein the at least one portion comprises at least one first transparent element, allowing for the viewing of the article, and at least one second element having the first motif associated therewith, and wherein the first and second elements extend in different planes.

2. A packaging unit according to claim 1, wherein the portion is configured such that, in a third direction of observation distinct from the first and second, a second decorative motif can be seen, and wherein said second decorative motif is one of identical to the first and different from the first.

3. A packaging unit according to claim 2, wherein the second element is in the shape of a strip.

4. A packaging unit according to claim 1, wherein the second element is in the shape of a strip.

5. A packaging unit according to claim 4, wherein the second element includes a plurality of strips arranged parallel to one another.

6. A packaging unit according to claim 5, wherein the first transparent element is made of one of a transparent material and an opening.

7. A packaging unit according to claim 1, wherein the first transparent element is made of one of a transparent material and an opening.

8. A packaging unit having a space for holding an article containing a cosmetic product, the packaging unit further comprising:

at least one portion configured such that, when seen in a first direction, at least a part of the article can be seen and, when seen in a second direction different from the first, a first decorative motif can be seen;

wherein the at least one portion comprises at least one first transparent element, allowing for the viewing of the article, and at least one second element having the first motif associated therewith, and wherein the first and second elements extend in different planes; and wherein the at least one portion comprises an insert formed from a sheet folded into a plurality of sections, and wherein at least some of said plurality of sections form said at least one second element.

9. A packaging unit according to claim 8, wherein some sections of said plurality of sections, other than sections forming said at least one second element, form said at least one first transparent element.

10. A packaging unit according to claim 1, wherein the at least one portion comprises an insert formed by one of extrusion of a thermoplastic material and molding from a single piece of a thermoplastic material.

11. A packaging unit according to claim 1, wherein said at least one portion comprises an insert formed by one of injection molding and thermoforming.

12. A packaging unit according to claim 1, wherein said packaging unit is in the form of a box.

13. A packaging unit according to claim 1, wherein said article is a perfume container.

14. A packaging unit according to claim 1, wherein said at least one second element includes first and second surfaces, and wherein said first decorative motif is associated with said first surface, and further wherein a second decorative motif is associated with said second surface.

15. A packaging unit according to claim 1, wherein said at least one second element includes a plurality of strips, and wherein said first motif is distributed over said plurality of strips such that said plurality of strips have a portion of said first motif associated therewith.

16. A packaging unit according to claim 15, wherein said plurality of strips each include a first surface and a second surface, and wherein said first motif is associated with said first surfaces, the packaging unit further including a second motif associated with said second surface.

17. A packaging unit according to claim 1, wherein said at least one second element further includes a second motif associated therewith and which can be seen from a third direction different from said first direction and said second direction, and wherein said first motif is not seen from said third direction, and further wherein said second motif is not seen from second direction.

18. A packaging unit as recited in claim 8, further including an article containing a cosmetic disposed in said space.

19. A packaging unit as recited in claim 18, wherein said article is a perfume container.

20. A packaging unit according to claim 1, further including at least one third transparent element, and wherein said at least one second element is disposed between said at least one first transparent element and said at least one third transparent element.

21. A packaging unit having a space suitable for containing an article, the packaging unit further comprising:

an article containing a cosmetic product, wherein said article is disposed in said space;

at least one portion which, viewed from a first direction, is configured to allow viewing of at least a part of the article and, viewed from a second direction different from the first, is configured to allow for a first motif to be seen, wherein the at least one portion comprises at least one first element, made of transparent material, allowing for the viewing of the article, and at least one second element having the first motif associated therewith, the two elements extending in different planes.

22. A packaging unit according to claim 21, wherein said article is a perfume container.

23. A packaging unit according to claim 21, wherein said at least one portion is further configured such that, viewed from a third direction different from the first or second direction, a second motif is seen.

24. A packaging unit according to claim 21, wherein said at least one portion further includes at least one third element formed of a transparent material, and wherein said at least one second element is disposed between said at least one first element and said at least one third element.

25. A packaging unit having a space for holding an article, the packaging unit further comprising:

an article containing a cosmetic product, wherein said article is disposed in said space;

at least one first element, said at least one first element including one of an opening and a transparent material, such that the article can be viewed through said first element in a first direction;

at least one second element, said at least one second element including a first surface having at least a portion of a first motif associated therewith, and wherein said first surface extends at an angle with respect to said at least one first element such that said first surface can be viewed in a second direction distinct from said first direction.

26. A packaging unit according to claim 25, wherein a plurality of said first surfaces are provided which are spaced from one another, and wherein said first motif is distributed over said plurality of first surfaces.

27. A packaging unit according to claim 26, wherein a view from said first direction is at least predominantly of said article and a view from said second direction is at least predominantly of said first surfaces to view said first motif.

28. A packaging according to claim 27, wherein said at least one second element includes a second surface having at least a portion of a second motif associated therewith, and wherein said second surface extends at an angle with respect to said at least one first element such that said second surface can be viewed in a third direction distinct from said first direction and distinct from said second direction.

29. A packaging unit according to claim 28, wherein a plurality of said second surfaces are provided which are spaced from one another, and wherein said second motif is distributed over said plurality of second surfaces.

30. A packaging unit according to claim 29, wherein a view from said third direction is at least predominantly of said second motif.

31. A packaging unit according to claim 30, wherein said first motif is not seen from said third direction and said second motif is not seen from said second direction.

32. A packaging according to claim 25, wherein said at least one second element includes a second surface having at least a portion of a second motif associated therewith, and wherein said second surface extends at an angle with respect to said at least one first element such that said second surface can be viewed in a third direction distinct from said first direction and distinct from said second direction.

* * * * *